US005450090A

United States Patent [19]

Gels et al.

[11] Patent Number: 5,450,090

[45] Date of Patent: Sep. 12, 1995

[54] MULTILAYER MINIATURIZED MICROSTRIP ANTENNA

[75] Inventors: Robert G. Gels, Boston; William L. Robbins, Newton Center, both of Mass.

[73] Assignee: The Charles Stark Draper Laboratory, Inc., Cambridge, Mass.

[21] Appl. No.: 278,049

[22] Filed: Jul. 20, 1994

[51] Int. Cl.[6] ..... H01Q 1/38

[52] U.S. Cl. ..... 343/700 MS; 343/846

[58] Field of Search ..... 343/700 MS, 829, 830, 343/731, 846, 847, 848; H01Q 1/38

[56] References Cited

U.S. PATENT DOCUMENTS 4,131,893 12/1978 Munson et al. ..... 343/700 MS
4,980,694 12/1990 Hines ..... 343/702
5,006,858 4/1991 Shirosaka ..... 343/700 MS

FOREIGN PATENT DOCUMENTS 2213995 8/1989 United Kingdom ..... H01Q 1/38
9101577 2/1991 WIPO ..... H01Q 1/38

OTHER PUBLICATIONS

Kieth R. Carver and James W. Mink, Microstrip Antenna Technology, IEEE Transactions on Antennas and Propagation, vol. AP-29, No. 1, Jan. 1981.

*Primary Examiner*—Donald Hajec
*Assistant Examiner*—Hoanganh Le
*Attorney, Agent, or Firm*—Lappin & Kusmer

[57] ABSTRACT

The present invention provides a miniaturized multilayer microstrip antenna that includes a stack of antenna sub-stacks, a ground element, and a plurality of electrically conductive segments. Each of the antenna sub-stacks includes a pair of substantially parallel outer principal faces. A sandwich of two relatively thin electrically non-conductive substrate elements, separated by a relatively thin electrically conductive layer, extends between each pair of parallel outer principal faces. The electrically conductive layer has at least one void region through which an electrically conductive feedthrough element extends. The feedthrough element also extends between the outer principal faces. The ground element electrically couples the conductive layers of each of the antenna sub-stacks. The electrically conductive segments are positioned between adjacent principal faces of two adjacent antenna sub-stacks in the stack, and electrically connect the feedthrough elements of the adjacent antenna sub-stacks, thereby establishing a first continuous elongated antenna element.

16 Claims, 9 Drawing Sheets

MULTILAYER MINIATURIZED MICROSTRIP ANTENNA

BACKGROUND OF THE INVENTION

The present invention relates generally to the design and construction of microstrip antennas. More particularly, the invention relates to microstrip antennas having a plurality of interconnected segments which are disposed on successive layers of a multilayer substrate.

Typically, half wavelength patch, microstrip, and stripline antennas (hereinafter referred to collectively as "microstrip" antennas) are generally required to have a length:

$$l_{conductor} = \frac{\lambda}{2} \approx \frac{c}{2f\sqrt{\epsilon_R}}$$

where $f$ is the operating frequency of the antenna, c is the speed of light in a vacuum, and $\epsilon_R$ is the relative dielectric constant of the substrate.

FIG. 1A shows a perspective view of a typical prior art half wavelength microstrip antenna 100. FIG. 1B shows a side view of the prior art antenna 100. According to prior art designs, the microstrip antenna 100 can have a variety of geometries, such as rectangular, circular, or pentagonal. Such antennas are typically constructed by forming an electrical conductor 102 on top of an electrically insulating substrate 104. The method of electrical connection to the conductor 102 can vary. By way of example, antenna 100 is shown adapted for connection through a probe feed 106. Alternatively, antenna 100 can include a microstrip connection or a capacitively coupled connection.

During operation, the conductor 102 radiates in response to receiving a signal having a wavelength, λ, equal to twice the length of the conductor 102. That is:

$$l_{conductor} = \frac{\lambda}{2} = \frac{c}{2f\sqrt{\epsilon_{Effective}}}$$

where $\epsilon_{Effective}$ is the; effective relative dielectric constant of the antenna. As is well known, the value of $\epsilon_{Effective}$ is a function of the geometry of the conductor 102, in addition to $\epsilon_R$. Typically $\epsilon_{Effective}$ approaches $\epsilon_R$ as W/h becomes large, where W is the width of the conductor and h is the thickness of the substrate 104.

FIG. 2 shows an equivalent electrical circuit for the half wavelength antenna of FIGS. 1A and 1B. As shown, the resonant antenna 100 can be viewed as a half wavelength transmission line, with capacitors $C_{edge1}$ and $C_{edge2}$, corresponding to the fringing fields, in combination with the relatively high resistances $R_{edge1}$ and $R_{edge2}$ corresponding to the radiation resistance of the radiating edges 102*a* and 102*b* of the conductor 102.

The prior an antenna 100 shown in FIGS. 1A and 1B suffers from the drawback: that its actual length varies inversely with the frequency at which the antenna 100 operates. Consequently, antennas designed for operation below a few Gigahertz or so, when constructed with substrates made from conventional ceramics or other conventional materials, are far too large and heavy for many applications. Additionally, where those large and heavy antennas can be used, the size results in excessive manufacturing and materials costs.

Some prior art systems reduce the antenna size by using materials with higher dielectric constants. However, many of these materials have undesirable properties, not present in lower dielectric constant materials. Such properties of concern include: the temperature coefficient of expansion; the temperature coefficient of dielectric constant; the dissipation factor (Q); the thermal conductivity; the environmental stability; and the durability. Also, microstrip antennas constructed on high dielectric constant substrates often excite undesirable modes, such as for example, surface waves which detract from the radiated power in the desired mode of operation. Further, higher dielectric substrate materials are generally more expensive than conventional substrate materials.

Consequently, an object of the present invention is to provide a microstrip antenna having a reduced size.

Another object of the present invention is to provide a microstrip antenna having a reduced size, and constructed from conventional materials.

A further object of the present invention is to provide a small, lightweight microstrip antenna for operation in a range of frequencies below a few Gigahertz.

Other general and specific objects will in part be obvious and will in part appear hereinafter.

SUMMARY OF THE INVENTION

The present invention relates generally to the design and construction of a microstrip antenna. More particularly, the invention relates to a multilayer microstrip antenna. According to one preferred embodiment, the antenna includes a stack of antenna sub-stacks, a ground element, and a plurality of electrically conductive segments. Each of the antenna sub-stacks includes a pair of substantially parallel outer principal faces. A sandwich of two electrically non-conductive substrate elements, separated by an electrically conductive layer, extends between each pair of parallel outer principal faces. The electrically conductive layer has at least one void region through which an electrically conductive feedthrough element extends. The feedthrough element also extends between the outer principal faces. The ground element electrically couples the conductive layers of each of the antenna sub-stacks. The electrically conductive segments are positioned between adjacent principal faces of two adjacent antenna sub-stacks in the stack, and electrically connect the feedthrough elements of the adjacent antenna sub-stacks, thereby establishing a first continuous elongated antenna element.

The antenna can also include an electrically conductive layer disposed on an unopposed outer principal face of one end of the stack. This conductive layer includes a void region positioned about the feed through element at the outer principal face. This conductive layer is spaced apart from the feed through element and is electrically connected to the electrically conductive layers of the stack. The antenna can also include an electrically conductive segment disposed on an unopposed principal face of one end of the stack. This segment can be connected to the feedthrough element of the principal face.

According to a further embodiment of the invention, the antenna sub-stacks can include a second void region and a second electrically conductive feedthrough element, along with additional electrically conductive segments. The second feedthrough element extends between the outer faces and through the second void region and is spaced apart from the conductive layer. The additional conductive segments, are positioned between adjacent principal faces of two adjacent antenna sub-stacks in the stack and electrically connect to the second feedthrough elements of the adjacent antenna sub-stacks. In this way, a second continuous antenna element is established. According to this embodiment, the antenna also includes an element for electrically connecting the first and the second continuous antenna elements at one end of the stack.

The, conductive segments of the antenna can be fabricated to have various geometries. By way of example, the conductive segments can be substantially rectangular, having a width W and a length L, wherein W/L is sufficiently small so that the antenna is operative as a dipole. Alternatively, W/L can be sufficiently large so that the antenna operates as a cavity resonator.

According to other embodiments, a plurality of antennas according to the invention can be interconnected in a variety of configurations. By way of example, two multilayer microstrip antennas can be coupled together to form a circularly polarized antenna. Additionally, several antennas can be formed on the same stack, wherein each antenna is responsive to a different frequency waveform. Further, the antennas of the present invention can be arranged as a phased array antenna.

The invention accordingly comprises the apparatus exemplified in the following detailed disclosure, the scope of which is indicated in the claims.

BRIEF DESCRIPTION OF THE DRAWINGS

For a fuller understanding of the nature and the objects of the invention, reference should be made to the following detailed description and the accompanying drawings in which like reference numerals refer to like elements and in which.

DESCRIPTION OF THE ILLUSTRATED EMBODIMENT

Figure 1A:
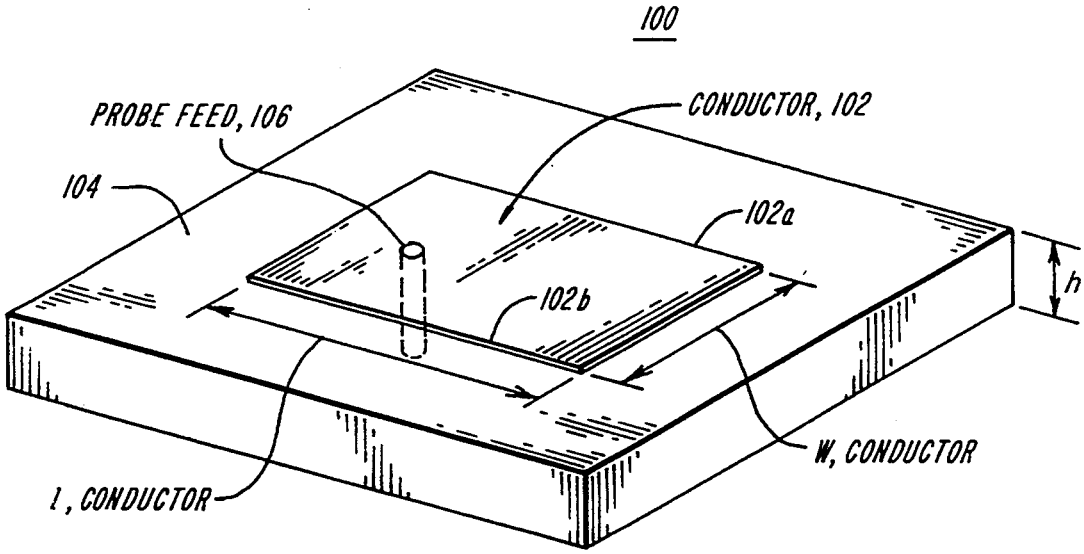
FIG. 1A (PRIOR ART)
FIG. 1A shows a perspective view of a prior art half wavelength microstrip antenna.
Figure 1B:
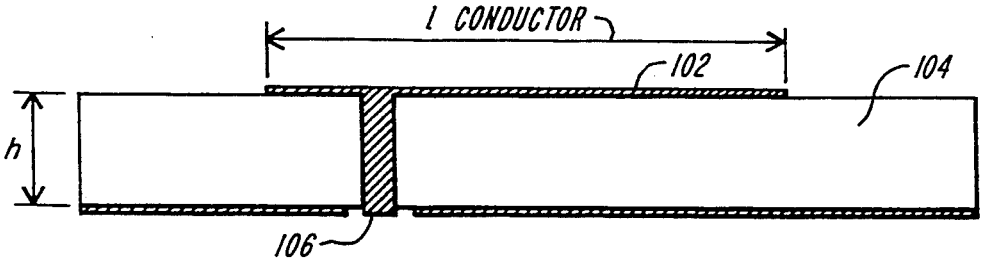
FIG. 1B (PRIOR ART)
FIG. 1B shows a side view of the microstrip antenna of FIG. 1A.
Figure 2:
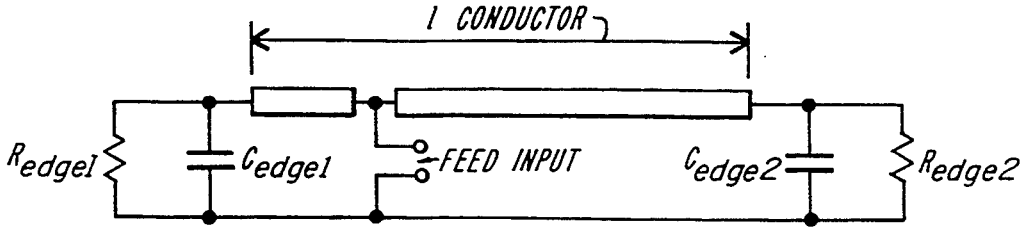
FIG. 2 (PRIOR ART)
FIG. 2 shows an equivalent electrical circuit for the microstrip antenna of FIGS. 1A and 1B.
Figure 3:
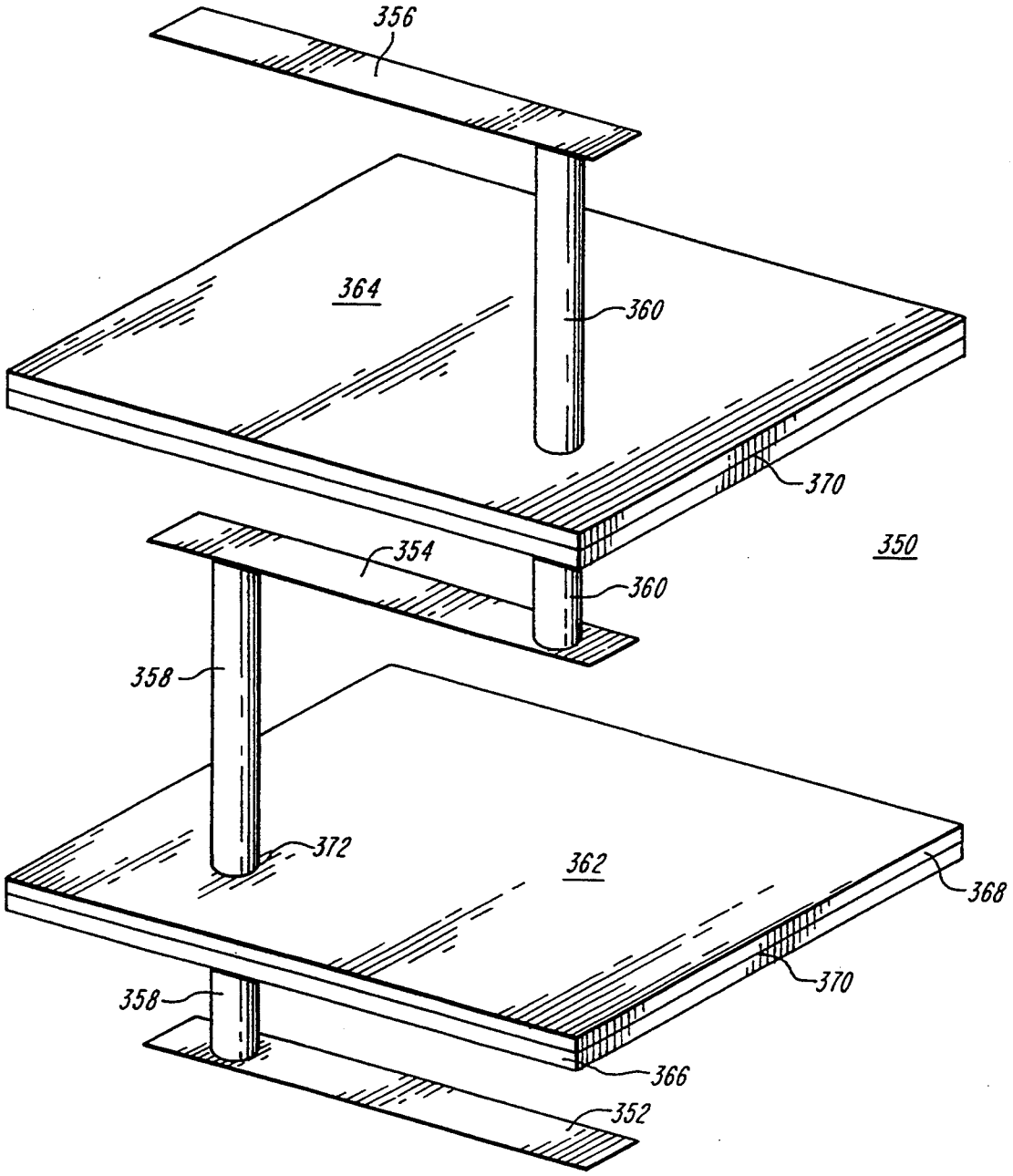
FIG. 3 shows an exploded view of a multilayer microstrip antenna according to the present invention.

FIG. 3 shows an exploded view of a microstrip antenna 350 according to one embodiment of the present invention. As depicted, the microstrip antenna 350 is formed from three antenna segments 352, 354, 356, which are connected together by two feedthrough elements 358, 360. Each of the feedthrough elements passes through one of two antenna substacks 362, 364. Each of the antenna substacks is composed of a sandwich of two non-conductive substrate elements separated by a conductive ground plane layer. For example, substack 362 is composed of substrate elements 366 and 368 and conductive layer 370. The feedthrough elements 358, 360 pass through insulated holes in substacks 362, 364 to maintain electrical isolation between the conductive segments 352, 354, 356 and the ground layers 370. For example, feedthrough 358 passes through insulated hole 372 in substack 362.

In practice, a completed antenna also contains elements (not shown) for connecting together the ground layers of the substacks, and also for coupling a signal to one of the antenna segments. Further, the antenna is fabricated so that the substacks 362, 364 are bonded together, and the outer conductive elements 352, 356 are bonded to the outer principal faces of the substacks. Essentially, the conductive antenna element is formed of folded segments, 352, 354, 356, such that any two segments are separated by at least one ground layer.

As described below, antennas according to the invention can contain more than two substacks, and can further contain more than one conductive element between any two adjacent substacks. FIG. 3 shows that each substack is composed of two substrate elements sandwiched around a conductive ground layer, and that conductive antenna segments are disposed between adjacent substacks or on the outer principal faces of substacks. In other figures, the substacks are not shown as discrete elements, and the layers of the antenna are shown grouped differently. Those skilled in the art will appreciate that the different groupings shown in other figures are merely a matter of convenience for describing the construction of antennas according to the invention and do not affect the functionality of the invention.

FIG. 3 also shows the non-conductive substrate elements 366, 368 having a relatively thin shape, i.e., the thickness of the substrate elements is small relative to the other principal dimensions of length and width. As those skilled in the art will appreciate, many shapes are possible for the substrate elements, and they need not be relatively thin as shown in the illustrated embodiment. By way of example, the thickness of the substrate element could be comparable to the width dimension. The same is true for the conductive ground layer 370.

Figure 4A:
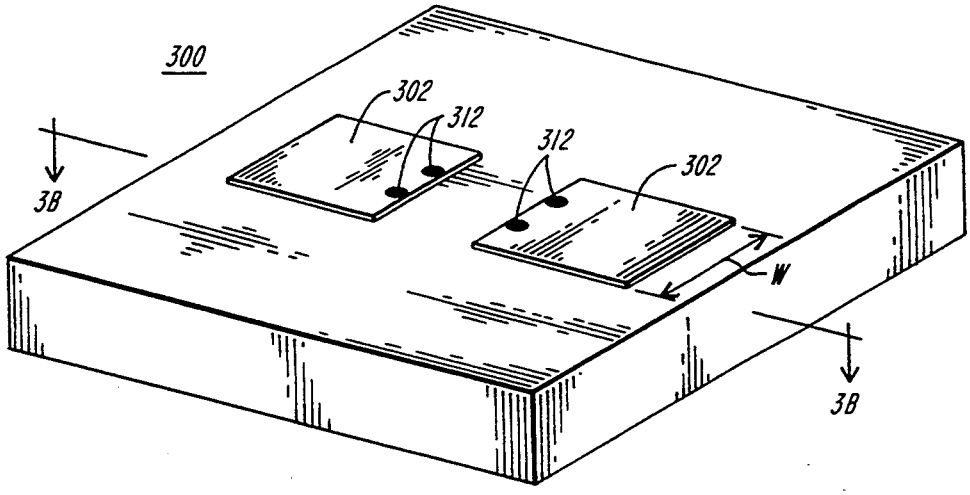
FIG. 4A shows a perspective view of a multilayer half wavelength microstrip antenna according to the present invention.
Figure 4B:
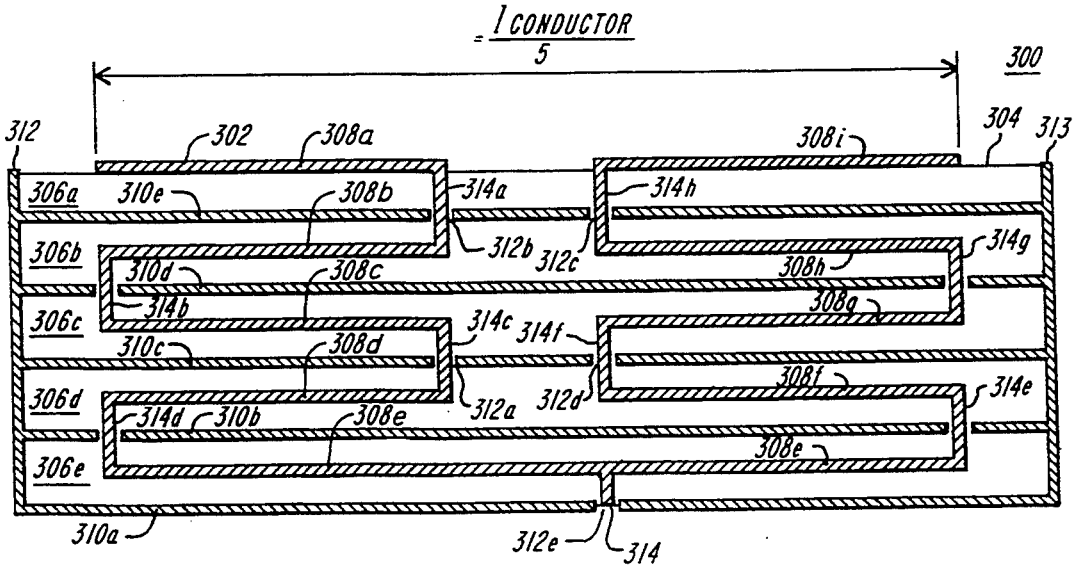
FIG. 4B shows a sectional view of the microstrip antenna of FIG. 4A along lines 3B—3B.

FIGS. 4A and 4B show a half wavelength microstrip antenna 300 according to one embodiment of the present invention. As depicted, the microstrip antenna 300 is formed from a conductive strip 302 disposed on a plurality of successive layers 306a–306e of a multilayer substrate 304. FIG. 4A shows a perspective view of the antenna 300, while FIG. 4B shows a sectional view of the antenna 300. As can be seen in FIG. 4B, the conductor 302 is formed from a plurality of segments 308a–308i. The segments 308a–308i can each be disposed on a separate layer 306a–306e of the multilayer substrate 304. Alternatively, as shown in FIG. 4B, more than one segment can be located on each layer. In order to substantially eliminate coupling between adjacent ones of the segments 308a–308i, the antenna 300 includes ground planes 310a–310e. The ground planes are, interconnected via conductors 312 and 313. The ground planes 310a–310e are located between adjacent conductor segments. By way of example, ground plane 310e is located between segment 308a and segment 308b.

The antenna 300 also provides insulated holes 312a–312e. The holes 312a–312d enable the conductor 302 to pass from layer to layer in the substrate 304, without shorting to any of the ground planes 310a–310e. Similarly, the hole 312e provides access to the conductor 302 for an antenna feed point 314.

By dividing the antenna conductor 302 into segments 308a–308i, and disposing those segments on multiple layers of the substrate 304, the invention allows a relatively long antenna to be packaged in a relatively small device. By way of illustration, in the depicted antenna 300, the conductor 302 has an actual length (lconductor) equal to the sum of all of the segments 308a–308i plus the sum of the lengths of the interlayer connections 314a–314h. However, as shown in FIG. 4B, the length of the physical device is approximately lconductor/5.

The invention incorporates multiple layers of ground planes 310a–310e to prevent unwanted coupling between the stacked segments. This ensures that the segments on each level 306a–306e do not couple or interact with the segments on adjacent layers in unintended ways. Consequently, according to the invention, all of the segments perform as one continuous conductor.

Figure 4C:
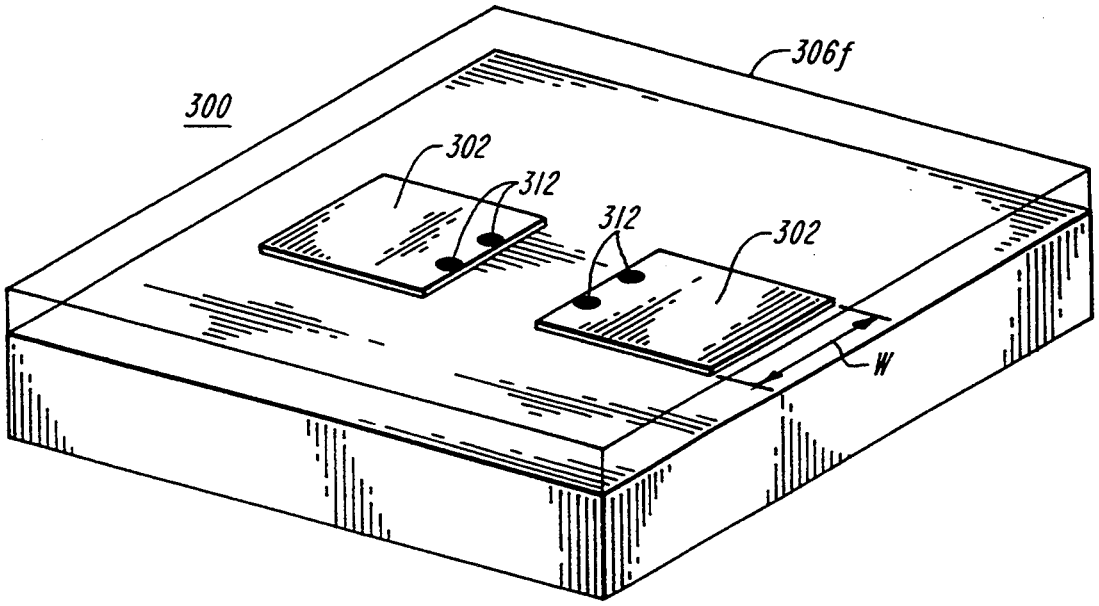
FIG. 4C shows a perspective view of an other multilayer microstrip antenna according to the present invention.

While the above discussion is directed to the geometry of the antenna 300 of FIGS. 4A & 4B, those skilled in the art will appreciate that any number of geometries can be employed in the construction of the conductor 302. By way of example, the conductor 302 can have a length (lconductor) and a width (W) such that both dimensions are an appreciable fraction of the wavelength (λ) of the signal to be received or transmitted (e.g. up to approximately λ/2). In such a configuration the antenna 300 operates as a two-dimensional cavity resonator. Alternatively, W can be reduced to a small fraction of λ (e.g. less than approximately λ/8), whereby the antenna 300 operates as a thin rectangular dipole. In yet other configurations, the antenna 300 can be circularly polarized. Moreover, as shown in FIG. 4C, in another embodiment antenna 300 may include a non-conductive layer 306f, such as a substrate layer, over the outer portion of conductor 302.

Figure 5:
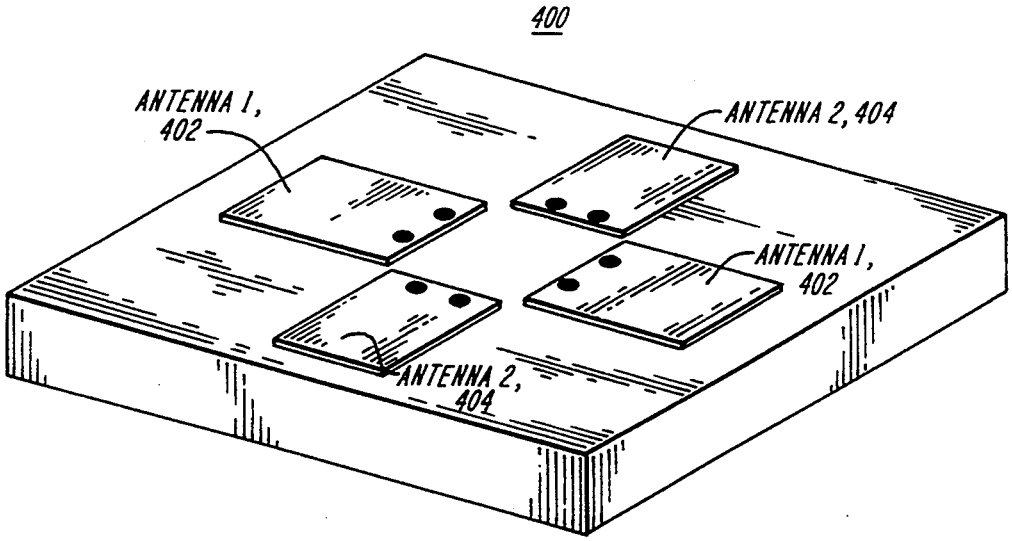
FIG. 5 shows a perspective view of a circularly polarized multilayer miniaturized half wavelength patch antenna according to the present invention.

FIG. 5 shows a perspective view of a circularly polarized half wavelength microstrip antenna 400 according to the invention. Circular polarization is achieved by orienting two antennas 402 and 404 perpendicular to each other, and driving them in such a way that the electromagnetic excitations of antennas 402 and 404 are ninety degrees out of phase with each other (i.e., in quadrature). Each of the antennas 402 and 404 are constructed in a like manner with antenna 300 of FIGS. 4A and 4B.

Quadrature excitation for circular polarization can be achieved in several ways. One method is to use a feed circuit, which splits an input signal, and provides a differential phase shift between its outputs of ninety degrees. The two outputs of the: feed circuit are then connected to the inputs of the two perpendicularly oriented antennas 402 and 404. The inputs to antennas 402 and 404, as in the case of feed point 314 of antenna 300, can be constructed as a probe interface, a microstrip interface, or a capacitively coupled interface.

The additional complexity of a feed circuit can be avoided by constructing the antennas to have slightly different resonant frequencies, and operating the antennas between the two frequencies. When the resonant frequencies are properly spaced, the currents entering each antenna end up in quadrature.

Figure 6:
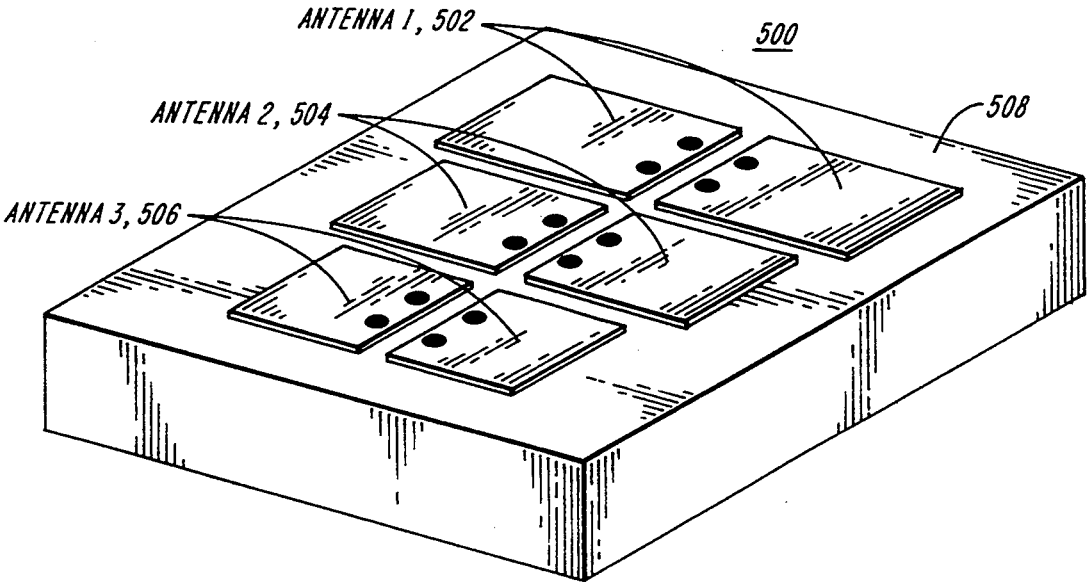
FIG. 6 shows three closely spaced multilayer miniaturized half wavelength patch antennas according to the present invention.

FIG. 6 shows a further embodiment of the invention wherein the antenna 500 is adapted for receiving multiple frequencies. The antenna 500 includes three multilayer half wavelength antennas 502, 504, and 506, located next to each other on the substrate 508. Each antenna has a different effective length, and thus each is designed to receive a different frequency.

Figure 7:
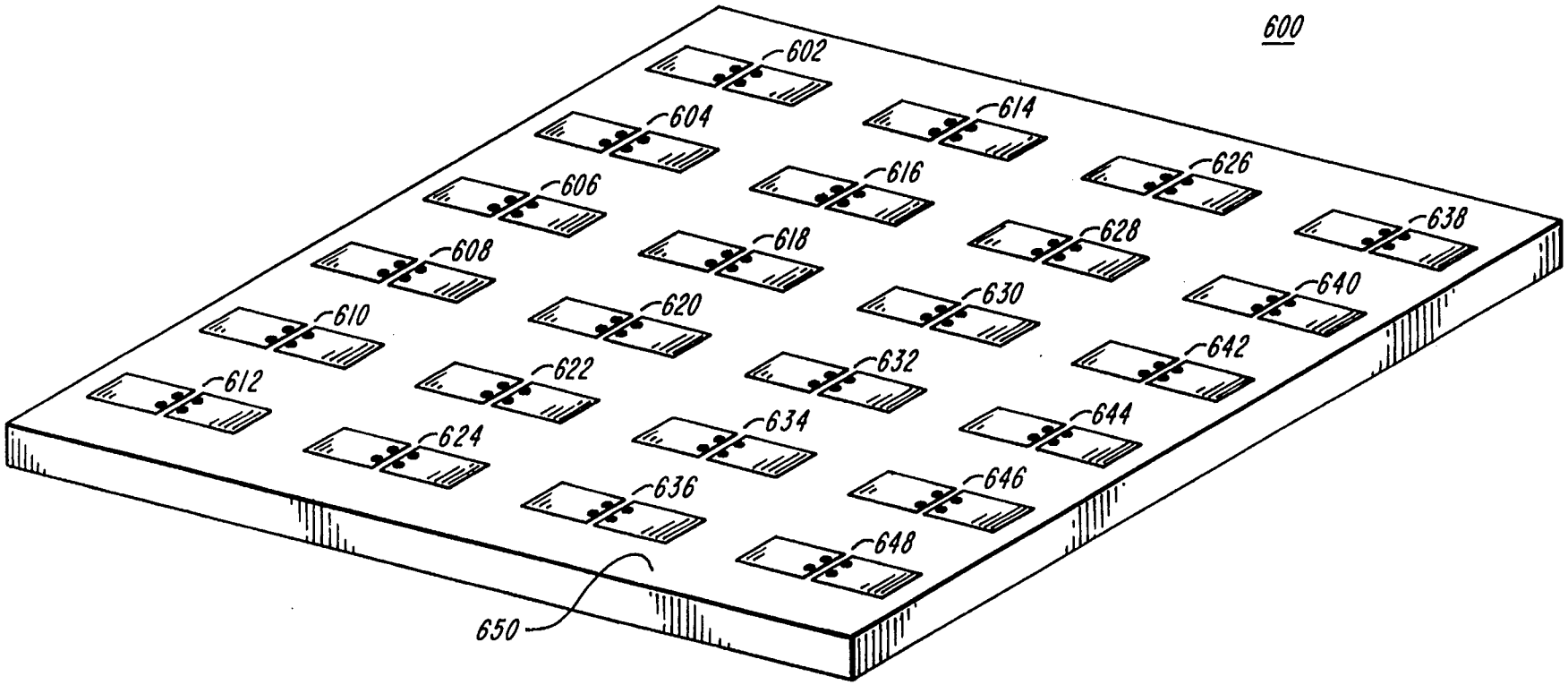
FIG. 7 shows a plurality of multilayer miniaturized half wavelength patch antennas arranged as a phased array.

FIG. 7 shows a further embodiment of the invention wherein a plurality of multilayer half wavelength antennas 602–648 (even numbers only) are arranged as a phased array antenna 600. It is possible, but not necessary, to incorporate the array 600 on a single substrate 650. Each antenna may be excited by a signal having an associated phase in keeping with conventional phased array techniques.

As discussed previously, connection can be made to microstrip antennas via a probe coupling, stripline coupling, or capacitive coupling.

Figure 8:
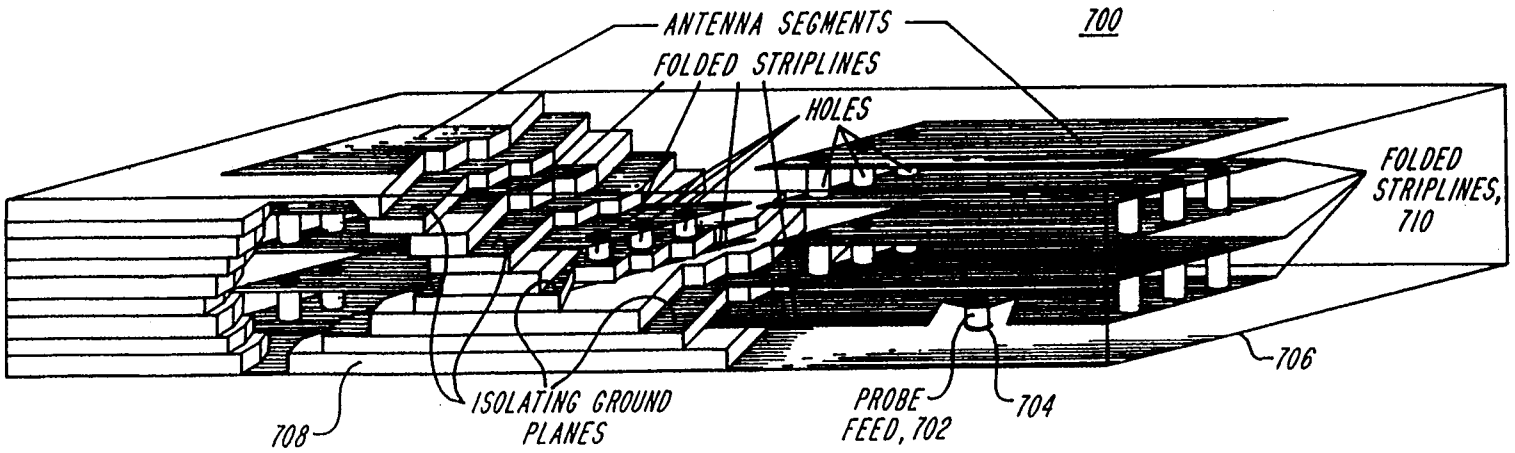
FIG. 8 shows a partially broken away perspective view of the microstrip antenna of FIGS. 4A and 4B incorporating a probe feed.

FIG. 8 shows a partially broken away view of a multilayer half wavelength antenna 700, according to the invention, which incorporates a probe feed 702. As can be seen, an insulated hole 704 is formed through the bottom ground plane 706 and the bottom substrate layer 708. A metal probe (wire) can couple to the antenna segment 710 through the hole 704.

Figure 9:
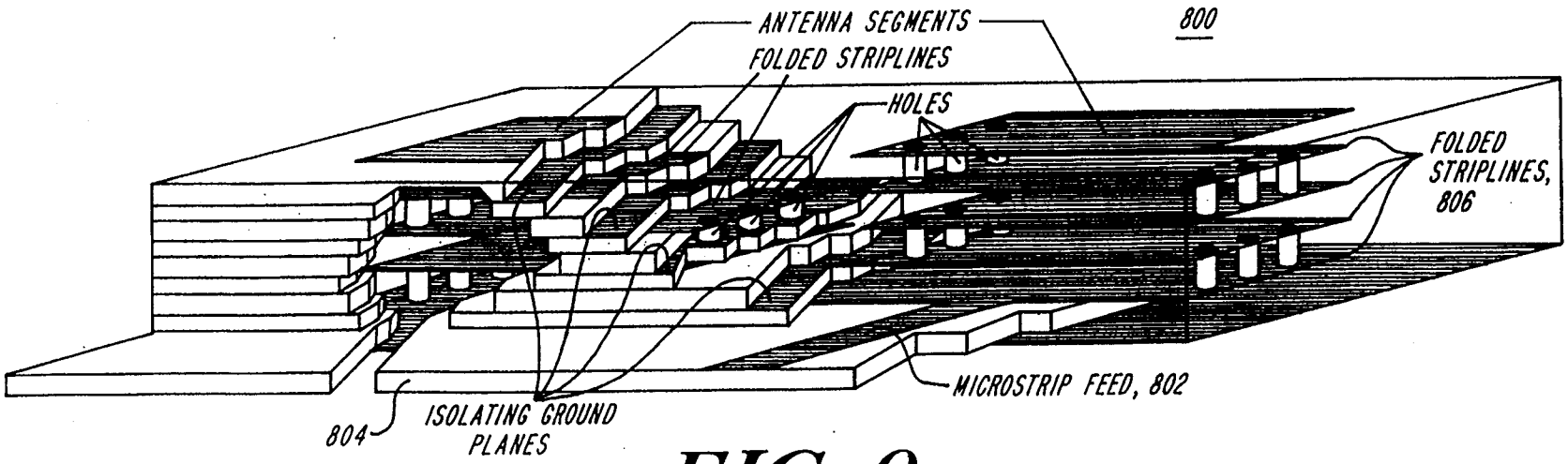
FIG. 9 shows a partially broken away perspective view of the microstrip antenna of FIGS. 4A and 4B incorporating a strip line feed.

FIG. 9 shows a partially broken away view of a half wavelength antenna 800, according to the invention, which incorporates a microstrip feed 802. The microstrip feed 802 is formed on the bottom substrate layer 804. The microstrip feed provides a connection to the antenna 800 by way of the antenna segments 806.

Figure 10:
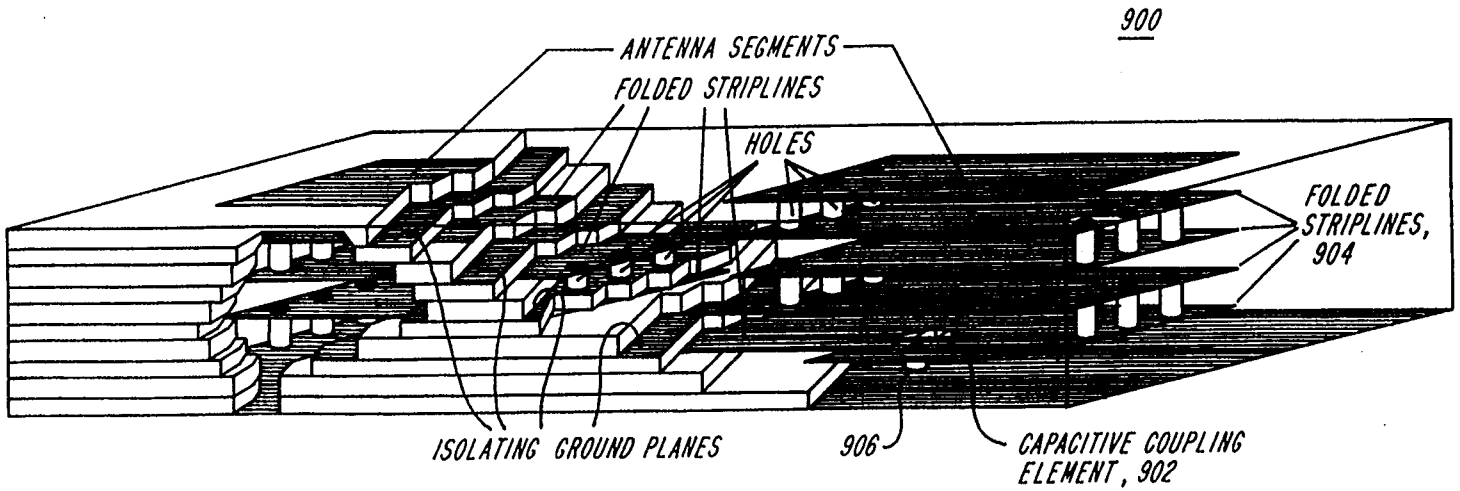
FIG. 10 shows a partially broken away perspective view of the microstrip antenna of FIGS. 4A and 4B incorporating a capacitive coupling element.

FIG. 10 shows a partially broken away view of a half wavelength antenna 900, according to the invention, which incorporates a capacitively coupled feed 902. With capacitive coupling, a buried metal plate 902 is placed near one or more of the antenna segments 904. External connection to the plate 902 can be made with either a probe, as shown at 906, or a microstrip.

While the above discussion focuses on half wavelength antennas, the invention can be employed to construct antennas of any wavelength. By way of example, according to a further embodiment of the invention, a multilayer quarter wavelength microstrip antenna can be constructed.

In a quarter wavelength microstrip antenna:

$$l_{conductor} = \frac{\lambda}{4} \approx \frac{c}{4f\sqrt{\epsilon_R}}$$

where $f$ is the operating frequency of the antenna, c is the speed of light in a vacuum, and $\epsilon_R$ the relative dielectric constant of the substrate.

Figure 11A:
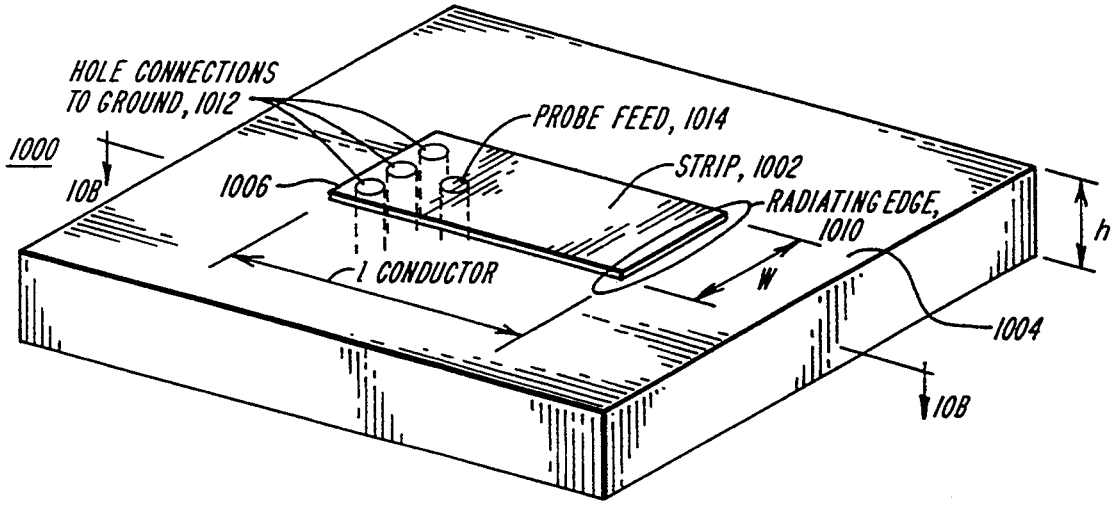
FIG. 11A (PRIOR ART)
FIG. 11A shows a perspective view of a conventional quarter wave patch antenna.
Figure 11B:
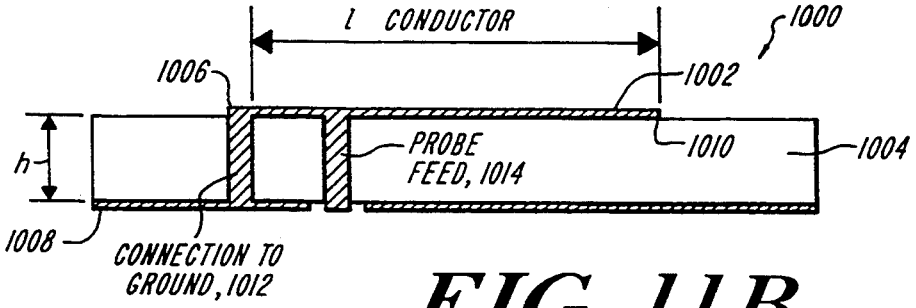
FIG. 11B (PRIOR ART)
FIG. 11B shows a sectional view of the microstrip antenna of FIG. 11A along lines 10B—10B.

FIGS. 11A and 11B show a perspective and a sectional view, respectively, of a prior art quaffer wavelength microstrip antenna 1000. As can be seen, the antenna 1000 is constructed by forming an electrical conductor 1002 on an electrically insulating substrate 1004. One edge 1006 of the conductor 1002 is connected to a ground plane 1008, via conductor 1012. The opposing edge 1010 forms a radiating edge. As with the half wavelength microstrip antennas, the method of electrical connection to the conductor 1002 can vary. By way of illustration, FIG. 11B shows a probe feed 1014 for connecting to the conductor 1002. As is well known, the conductor 1002 radiates in response to a signal having a wavelength λ equal to four times the length of the conductor 1002. In other words:

$$l_{conductor} = \frac{\lambda}{4} = \frac{c}{4f\sqrt{\epsilon_{Effective}}}$$

where $\epsilon_{Effective} \leqq \epsilon_R$.

Figure 12:
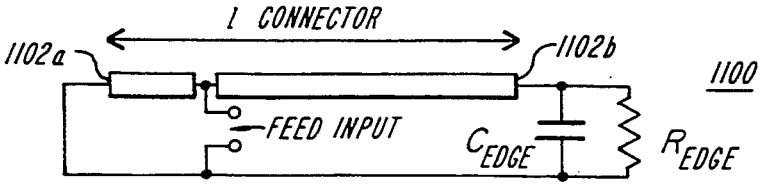
FIG. 12 (PRIOR ART)
FIG. 12 shows an equivalent electrical circuit for the microstrip antenna of FIGS. 11A and 11B.

FIG. 12 shows an equivalent electrical circuit 1100 for the antenna of FIGS. 11A and 11B. As is well known, the antenna 1000 can be viewed as a quaffer wavelength transmission line, with a capacitor $C_{edge}$ corresponding to the fringing fields at edge 1010, along with a relatively high resistance corresponding to the radiation resistance of edge 1010. Elements 1102*a* and 1102*b* correspond to the conductor 1002.

Figure 13:
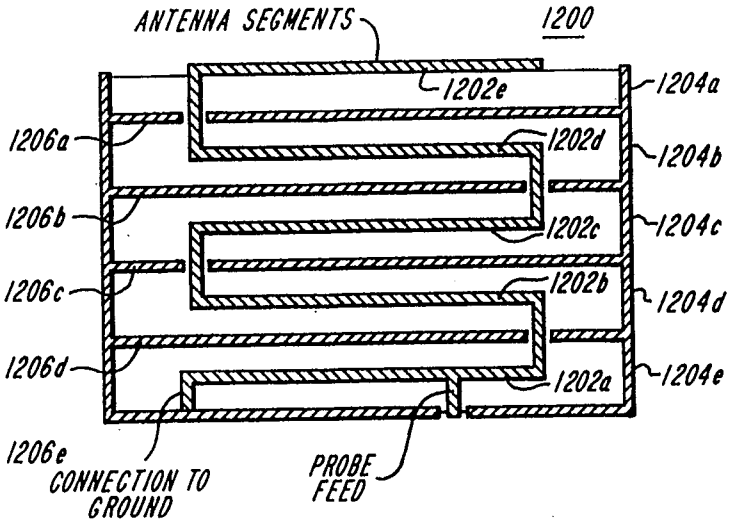
FIG. 13 shows a side view of a multilayer quarter wave microstrip antenna according to the present invention.

FIG. 13 shows a side view of a microstrip antenna 1200 which is constructed according to the invention. As in the case of the half wavelength embodiment, the structure of the invention folds the single layer quarter wavelength conductor into a multilayer structure. Thus, a plurality of antenna segments 1202*a*–1.202*e* are disposed on successive layers 1204*a*–1204*e* of an electrically insulative substrate. Consequently, the effective depth of the conductor is maintained, although the largest linear dimension of any one segment is reduced proportionately to the number of layers. As with the half wavelength embodiment, the antenna 1200 incorporates ground planes 1206*a*–1206*e* to eliminate coupling between adjacent conductor segments.

Thus, as can be seen from the above discussion, one advantage of the present invention is that it allows for the construction of a smaller and lighter antenna built from conventional well characterized materials which are suitable for operation from low frequency ranges (e.g., tens of Megahertz) to a few Gigahertz. Also, the invention provides for a variety of conductor geometries. The invention has the further advantage of an N-fold size reduction over prior art antennas, where N is the number of substrate layers.

By way of example, a prior art 225 MHz antenna built as a microstrip conductor on a ceramic substrate with a relative dielectric constant of 7.8 may be at least 9.4 inches long. However, by fabricating a multilayer microstrip antenna with ten layers, according to the invention, the length can be reduced to under one inch for a corresponding frequency antenna.

As previously discussed, high dielectric constant substrates suffer from several potential drawbacks. However, if yet further size reductions are called for, the multilayer structure of FIGS. 4A and 4B can be used in combination with high dielectric constant substrates to attain an even greater size reduction. By way of example, a 30 MHz communication antenna built as a microstrip conductor on a ceramic substrate with a high relative dielectric constant of 80 is at least 22 inches long. However, if the same ceramic is used in a multilayer microstrip antenna, with ten layers, an antenna slightly more than 2.2 inches long can be built.

As one skilled in the art will appreciate, the present invention has wide commercial applications. By way of example, virtually any mobile radio system operating below several Gigahertz could benefit from the size reduction offered by multilayer antennas. Such applications include cellular telephone systems (which currently operate around 900 MHz, but may move to near 2 GHz) and the proposed personal communication systems (PCN's, which are projected to operate around 1.8 GHz). Wireless computer links and networks (LAN's) can also benefit from these antennas.

By way of further example, commercial navigation systems, such as the global positioning system (GPS) can utilize these antennas. A number of portable GPS receivers are currently on the market, and at least one manufacturer has found it worthwhile to use high dielectric materials ($\epsilon_R$ of approximately 30) to achieve a reduction in antenna size. The same or a greater reduction in antenna size can be achieved using the multilayered structure of the invention. By using the methodology of the present invention, GPS antennas can be reduced to the size of a dime.

In this way, the present invention provides a microstrip antenna having a reduced size and being capable of operating below a few Gigahertz. Moreover, the invention enables construction of a reduced size microstrip antenna, without requiring the use of substrates having high dielectric constants.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

Having described the invention, what is claimed as new and secured by Letters Patent is:

1. An antenna comprising:

A. a stack of n antenna sub-stacks, where n is an integer greater than or equal to two, each of said antenna sub-stacks including a pair of substantially parallel outer principal faces and extending therebetween:

i. a sandwich of two electrically non-conductive substrate elements separated by an electrically conductive layer having at least one void region, and ii. an electrically conductive feedthrough element, said feed through element extending between said outer faces and through said void region and being spaced apart from said conductive layer, B. ground means for electrically coupling together each conductive layer of said antenna sub-stacks, and C. n−1 electrically elongated conductive segments, each of said conductive segments having two ends and being positioned between adjacent principal faces of two adjacent antenna sub-stacks in said stack and at one of said ends electrically connecting said feedthrough element of a first of said adjacent antenna sub-stacks, and at the other of said ends electrically connecting said feedthrough element of a second of said adjacent sub-stacks, thereby establishing a first continuous elongated antenna element.

2. An antenna according to claim 1 further comprising an electrically conductive layer disposed on an unopposed outer principal face of one end of said stack and having a void region positioned about said feedthrough element at said unopposed outer principal face, said electrically conductive layer being spaced apart from said feedthrough element and being electrically connected to each electrically conductive layer of said stack.

3. An antenna according to claim 1 further comprising an outer electrically conductive segment disposed on a first unopposed principal face of one end of said stack and being connected to said feedthrough element of said first unopposed principal face.

4. An antenna according to claim 3 further comprising an electrically conductive layer disposed on a second unopposed principal face of an end of said stack distal from said one end and having a void region positioned about said feedthrough element at said second unopposed principal face, said electrically conductive layer being spaced apart from said feedthrough element and being electrically connected to each electrically conductive layer of said stack.

5. An antenna according to claim 3 further comprising an electrically non-conductive substrate layer disposed over said outer electrically conductive segment.

6. An antenna according to claim 1 wherein said conductive layer of each of said antenna sub-stacks includes a second void region and wherein each of said antenna sub-stacks includes a second electrically conductive feedthrough element, said second feedthrough element extending between said outer faces and through said second void region and being spaced apart from said conductive layer, n−1 additional electrically conductive segments, each of said additional conductive segments being positioned between adjacent principal faces of two adjacent antenna sub-stacks in said stack and electrically connecting each second feedthrough element of said adjacent antenna sub-stacks, thereby establishing a second continuous antenna element and further comprising means for electrically connecting said first and second continuous antenna elements at one end of said stack.

7. An antenna according to claim 1 wherein said conductive segments are substantially rectangular having a width W and length L, and wherein W is sufficiently small so that said antenna is operative as a dipole.

8. An antenna according to claim 1 wherein said conductive segments are substantially rectangular having a width W and length L, and wherein W is sufficiently large so that said antenna is operative as a two dimensional cavity resonator.

9. An antenna according to claim 1 wherein each of said conductive segments are substantially rectangular having a width W and a length L, and wherein said antenna is responsive to a signal having a wavelength in the range of $\lambda$ and wherein both W and L are at least as large as $\lambda/10$.

10. An antenna according to claim 1 wherein said conductive segments are substantially rectangular having a width W and a length L, and wherein said antenna is responsive to a signal having a wavelength in the range of $\lambda$, and wherein W is less than $\lambda/10$.

11. An antenna according to claim 1 further comprising coupling means for coupling said antenna to external devices.

12. An antenna according to claim 11 wherein said coupling means includes a probe connection coupled to at least one of said conductive segments.

13. An antenna according to claim 11 wherein said coupling means includes a conductive plate, capacitively coupled to at least one of said conductive segments.

14. An antenna according to claim 11 wherein said coupling means includes a microstrip conductor disposed on an unopposed outer principal face of an end of said stack and connected to at least one of said conductive segments.

15. An antenna according to claim 1 wherein said non-conductive substrate elements define a principal dimension and a thickness, wherein said thickness is substantially smaller than said principal dimension.

16. An antenna according to claim 1 wherein each electrically conductive layer defines a principal dimension and a thickness, wherein said thickness is substantially smaller than said principal dimension.

* * * * *